United States Patent [19]

Kawano

[11] 3,988,173

[45] Oct. 26, 1976

[54] COLD ROLLED STEEL SHEET HAVING EXCELLENT WORKABILITY AND METHOD THEREOF

[75] Inventor: Tsuyoshi Kawano, Kisaragu, Japan

[73] Assignee: Nippon Steel Corporation, Tokyo, Japan

[22] Filed: July 11, 1975

[21] Appl. No.: 595,093

Related U.S. Application Data

[63] Continuation-in-part of Ser. No. 499,923, Aug. 23, 1974, abandoned, which is a continuation of Ser. No. 345,691, March 28, 1973, abandoned.

[30] Foreign Application Priority Data

| | | |
|---|---|---|
| Apr. 3, 1972 | Japan | 47-32563 |
| Apr. 3, 1972 | Japan | 47-32564 |
| Sept. 20, 1972 | Japan | 47-93685 |

[52] U.S. Cl. ..... 148/12 C; 148/36

[51] Int. Cl.[2] ..... C21D 9/48

[58] Field of Search ..... 148/36, 12 F, 12 C

[56] References Cited

UNITED STATES PATENTS

| | | | |
|---|---|---|---|
| 2,772,154 | 11/1956 | Morgan et al. | 75/123 B |
| 3,666,452 | 5/1972 | Korchynsky et al. | 148/12 F |
| 3,725,143 | 4/1973 | Alworth et al. | 148/36 |
| 3,765,874 | 10/1973 | Elias et al. | 148/12 C |
| 3,798,076 | 3/1974 | Shimizu et al. | 148/12 C |
| 3,821,031 | 6/1974 | Kubotera et al. | 148/12 C |
| 3,839,095 | 10/1974 | Kubotera et al. | 148/12 C |
| 3,897,280 | 7/1975 | Gondo et al. | 148/12 C |

*Primary Examiner*—W. Stallard

*Attorney, Agent, or Firm*—Toren, McGeady and Stanger

[57] ABSTRACT

A cold rolled steel sheet having excellent cold workability comprising not more than 0.10% of carbon, not more than 0.10% of silicon, not more than 0.50% of manganese, not more than 0.0080% of nitrogen, 0.003–0.080% of acid-soluble aluminum, 0.0020–0.0050% of boron, the balance being iron and unavoidable impurities.

13 Claims, No Drawings

COLD ROLLED STEEL SHEET HAVING EXCELLENT WORKABILITY AND METHOD THEREOF

CROSS REFERENCE TO RELATED APPLICATIONS

This application is a continuation-in-part of Ser. No. 499,923, filed Aug. 23, 1974, and now abandoned, the contents of which are incorporated herein by reference, which, in turn, is a continuation of application Ser. No. 345,691, filed Mar. 28, 1973, and now abandoned.

BACKGROUND OF THE INVENTION

1. Field of the Invention

The present invention relates to an Al-killed steel sheet having excellent workability and a production method thereof. More particularly the present invention relates to an Al-killed cold rolled steel sheet containing boron and a method for producing a cold rolled steel sheet having excellent cold workabilities by subjecting a hot rolled steel sheet to cold rolling and continuous annealing.

2. Description of the Prior Art

Conventionally, the Al-killed steel sheet has been widely used as a deep-drawing cold rolled steel sheet for the reason that AlN which precipitates during the annealing forms a recrystallization texture which is favorable for deep-drawing and the aluminum fixes the nitrogen to make the steel non-ageing. However, in order to obtain the excellent deep-drawability, it is necessary to slowly heat the steel at a temperature between 400° and 600° C at a heating rate of about 10° C/hour or to maintain the steel at this temperature. For this purpose, a box annealing has been conventionally practiced, which requires a considerable amount of time, e.g. as long as several days.

As a method for shortening the annealing time, a continuous annealing may be used instead of the box annealing. However, when Al-killed steel after cold rolling is subjected to a continuous annealing, the *r* value (Rank Ford value), which represents deep-drawability, is lower than that obtained by the box annealing because the heating rate is remarkably high in the continuous annealing. Even so, the recrystallization grains are remarkably smaller than those of a rimmed or capped steel so that an Al-killed cold steel sheet as continuously annealed is too hard to be used for deep-drawing.

For overcoming this defect, it has been known to increase the coiling temperature above 680° C (hereinafter called a high coiling temperature). Even in this case, the grains after the continuous annealing are still small, sufficient softness is not obtained, and the *r* value is low. Also, the acid pickling efficiency lowers due to the high coiling temperature and the harmful effect of the lump coalescent cementite remains even after the cold rolling and continuous annealing.

Thus, regarding the annealing after the cold rolling, when the annealing is conducted below the $A_1$ point, the lump cementite remains as it is. On the other hand, when the annealing is conducted above the $A_1$ point, a lump pearlite appears so that the cold steel sheet which is coiled at high temperature is not desirable for materials used for applications where local deformation ability is required, such as, local stretching.

SUMMARY OF THE INVENTION

One of the objects of the present invention is to provide a cold rolled steel sheet which is soft and non-ageing and also has deep drawability even if a rapid heating and short-time annealing, such as, a continuous annealing is conducted.

In other words, the object of the present invention is to provide a cold rolled steel sheet having ageing-resistance and similar or better cold workability than box annealed steel material even when it is subjected to continuous annealing due to the addition of very small amounts of B to an Al-killed steel.

The features of the present invention lie in a cold rolled steel sheet comprising not more than 0.10% of carbon, not more than 0.10% of silicon, not more than 0.50% of manganese, 0.003–0.080% of acid soluble aluminum, 0.0020 – 0.0050% of boron, not more than 0.008% of nitrogen, with the balance being iron and unavoidable impurities, which is subjected to hot rolling, cold rolling and then a recrystallization annealing treatment by a continuous annealing method, and if necessary, is subjected to a temper rolling.

The Al-killed steel containing a very small amount of B according to the present invention may contain one or more elements selected from the group consisting of W, P, Mo and Nb and may be subjected to a rapid heating and short-time annealing by a continuous annealing method to obtain a non-ageing cold rolled steel sheet, which is soft and ductile and yet has excellent deep-drawability. The above minor elements may be contained in the following range.

W : 0.01 – 0.08%
P : 0.040–0.15%
Mo : 0.01 – 0.10%
Nb : 0.01 – 0.08%

DESCRIPTION OF THE PREFERRED EMBODIMENT

It has been known that boron fixes nitrogen in the steel to make the steel non-ageing. In the hot rolled steel sheet, conventionally more than 0.007% of boron has been added to the steel for making the steel non-ageing. However, the present inventors have found that when boron is added to an Al-killed steel, not only is the nitrogen in the steel fixed as BN by the very small addition of boron even when a low temperature coiling (coiling temperature below 680° C is designated herein as a low coiling temperature) is conducted after the hot rolling, but also the boron promotes the AlN precipitation so that the aluminum addition may be smaller than when aluminum is added alone.

In the case of an Al-killed steel containing no boron, for example, a 0.04% Al – 0.0050% N steel, the steel is not made non-ageing unless the coiling is done above 700° C, while in the case of a 0.03% Al – 0.0030% B – 0.005% N steel, the steel is made non-ageing even be coiling at 600° C. When aluminum is added alone, more than 0.10% of acid soluble aluminum is required in order to make the steel non-ageing by coiling at 600° C. It is understood from this fact that the aluminum and boron contents can be remarkably lowered as compared with the conventional compositions. Therefore, production cost is lower and surface appearance is better than those by the conventional method. Also, when aluminum and boron are added in combination, a high coiling temperature is not necessary so that the coarse coalescent cementite which is harmful for applications where local deformation ability, such as, local stretching is required, is not formed, and the carbides are finely dispersed and good acid-pickling efficiency is obtained.

Further, a feature of a boron containing steel is that the ferrite grains after the hot rolling are enlarged. In the case of aluminum addition alone, the ferrite grain size is only 9 –9.5 by ASTM grain size number even when a high coiling temperature above 700° C is used, while the ferrite grain size of the present inventive steel containing boron is as large as 8 –8.5 by ASTM grain size number with a low coiling temperature at about 600° C. Thus a low yield point, excellent ductility, and deep-drawability can be obtained as compared with the case of a conventional steel.

In the case of a cold rolled steel sheet, conventionally, more than 0.007% of boron has been added to make the steel non-ageing, but such a large amount of boron lowers the *r* value after the cold rolling and the continuous annealing, and lowers the deep-drawability.

The present inventors found that the addition of boron in a smaller amounts to an Al-killed steel improves the mechanical properties remarkably after the continuous annealing just as in the case of the hot rolled steel sheet.

Thus the following facts have been confirmed.

1. The boron addition only fixes nitrogen in the steel as BN, but also, it promotes the precipitation of AlN so that the steel can be made non-ageing with a smaller amount of aluminum and boron then conventional;

2. as the boron addition is smaller than conventional, the lowering of the *r* value can be prevented;

3. further, due to the addition of boron in a very small amount, the recrystallization grains are remarkably larger than those in case of the aluminum alone addition, even when a rapid heating and short time holding, such as, a continuous annealing is applied;

4. The above mentioned advantages obtained by the addition of boron are not affected, even when the coiling is done at low coiling temperature. That is, even in this case, the recrystallization grains after the cold rolling and continuous annealing are larger than those of an Al-killed steel sheet containing no boron which is coiled at a high temperature, and the steel can be made non-ageing.

Thus, according to the present invention, the carbides after the cold rolling and annealing are finely dispersed and the cold workability (particular local deformation ability) is substantially improved by the combination with the low coiling temperature.

Also when a steel sheet which is softer and has better deep-drawability is required, it is desirable to apply the high coiling temperature, and even in this case, a cold rolled steel sheet which is softer and has better ductility can be obtained than an Al-killed steel sheet containing no boron and coiled at a high temperature.

5. As one of the features of the present invention, the very small addition of B remarkably improves the brittle fracture sensitivity after deep drawing. In general, when C is lowered, cold workability is improved, but on the other hand, the brittle fracture sensitivity deteriorates. Therefore, even through a conventional, extreme low-carbon steel can be subjected to strong deep-drawing, it is susceptible to brittle wall cracking after press forming, and for this reason, it has been practically impossible to apply strong cold working.

However, when a very small amount of B is added to the steel, the brittle fracture sensitivity after deep-drawing can be remarkably improved, and thus it is possible to attain a maximum degree of cold workability through the combination of a very small addition of B with an extremely low-carbon (C<0.010%) steel or a phosphorus containing steel which is considered to be defective with respect to the brittle fracture sensitivity.

Although according to the present invention, a cold rolled steel sheet which is softer and possesses better workability than an Al-killed steel sheet by the application of a continuous annealing can be obtained, the *r* value is somewhat lower than that of an Al-killed steel as box annealed.

The present inventors have conducted extensive studies and experiments with respect to improvement of the *r* value, and it has been found that it is possible to produce a cold rolled steel sheet having similar or better cold workability than that of an Al-killed, box-annealed steel by adding one or more of W, Mo, Nb and P in a small amount to a steel containing Al and B and limiting the Al and B contents in a specified range.

The reasons for limitations of the individual elements in the steel composition to be used in the present invention will be described hereinunder.

Although carbon increases the steel strength, it lowers the cold workability, the *r* value, and the deep-drawability of the cold-rolled steel sheet remarkably, and thus its upper limit is set at 0.10%. Particularly, when a steel sheet which is soft and has excellent cold workability is required, it is desirable to restrict the carbon content to 0.06% or less, and the cold workability, particularly the *r* value of a cold rolled steel sheet, is still further improved by lowering the carbon content to less than 0.015% (particularly preferably less than 0.010%) by vacuum degassing.

As silicon hardens the steel and lowers the cold workability, it is desirable not to add silicon where strength is not required. But, a silicon content up to 0.10% does not lower the cold workability substantially and thus the upper limit is set at 0.10%. However, Si increases amount of the silicate inclusions which are elongated by the hot rolling and lowers the cold workability, and thus the preferably range is not more than 0.02% which is an unavoidable range. Also, when Si is contained in an amount not less than 0.03% in order to increase the strength, the sol. Al should be more than 0.15% so as to prevent formation of the silicate inclusions which are harmful to the cold workability.

Manganese is necessary for preventing the redshortness due to sulphur, but hardens the steel and lowers the cold workability and the r value of a cold rolled steel sheet. Thus, its upper limit is set at 0.50%. But is is desirable to restrict the manganese content below 0.35% where strength is not specifically required and with a manganese content less than 0.25%, still more improved cold workability and remarkably improved deep-drawability of cold rolled steel sheet can be obtained.

Aluminum is required to be present as acid soluble Al in an amount of 0.003% and more for assuring the effect of boron and killing the steel and more than 0.015% is preferable in order to prevent formation of the silicate inclusions which are harmful to the cold workability. But, with an acid soluble aluminum content of more than 0.08%, not only is the effect of Al saturated, but also, the cleanness of the steel is deteriorated and further the ferrite grains are made finer and become nearly the same as in an Al-killed steel. Thus the upper limit is limited to 0.08%. However it is desirable to restrict the acid soluble aluminum content to less than 0.06% when better results are desired.

As mentioned before, a very small amount of boron not only fixes the nitrogen in the steel as BN when boron is used in combination with aluminum but also promotes the precipitation of AlN and can make the steel non-ageing with a smaller amount of each of Al and B than would conventionally be used. The smaller addition of boron prevents the lowering of the r value after the recrystallization, and with a very small amount of boron, the recrystallization grains become remarkably larger than those in case wherein aluminum is added alone, even when a rapid heating and short time holding, such as, continuous annealing is used, and a soft material having improved cold workability can be obtained. The above advantages of the boron addition are not affected when a high coiling temperature is not used after the hot rolling so that the carbides after the cold rolling and annealing are finely dispersed and the cold workability (particularly the local deformation ability) is still improved by the combination with the low coiling temperature.

Also, as mentioned before, B improves the brittle fracture sensitivity after deep-drawing remarkably, and this improving effect is still more remarkable in the case of a steel containing less than 0.010% C and a phosphorus-containing steel.

However, with a boron content less than 0.0020% the above effects can not be obtained, while with a boron content above 0.005%, not only are the effects saturated, but also, the cleanness of the steel is poor and the r value is lowered, and thus the deep-drawability is deteriorated. Thus the upper limit of the boron content is limited to 0.005%.

Normally, nitrogen is contained in an amount between 0.002 and 0.008% in an Al-killed steel, but it increases the ageing property and is harmful to the cold workability. Further, an increased amount of nitrogen increases the amount of Al and B required for non-ageing, and as a result, lowers the cold workability. Thus its upper limit is set at 0.008%.

The contents of aluminum and boron have been explained before, but it is desirable that the minimum total amount of (Al + B) is 2.7 × (N%) or more in order to fully develop the advantages of the present invention. As the total amount of (Al + B) increases, the ferrite grains become finer, and when the total amount exceeds 20 + (N%), the aluminum content also increases. Thus, the resultant properties of the steel are almost the same as those of the steel wherein aluminum alone is added. Thus it is desirable to limit the total amount of aluminum boron in addition to the limitations of each of Al and B as follows:

$$(Al + B) \leqq 20 \times [N\%]$$

In order to develop the advantages of the present invention, it is more desirable to limit this total amount as follows:

$$(Al + B) \leqq 15 \times [N\%]$$

In order to attain the desired results of the present invention, it is better to restrict the B content as low as possible, and it is desirable to maintain the ratio B/N to less than 1.0.

In addition to the above basic component, one or more W, Mo, Nb and P may be added when a cold rolled steel sheet having very excellent deep-drawability is to be produced by continuous annealing. All of W, Mo and Nb form carbides and improve the *r* value and deep-drawability, and W is limited to 0.01 – 0.08%, Mo is limited to 0.01 – 0.10% and Nb is limited to 0.01 – 0.08% for the following reasons. Each of these elements is not effective for improving the r value, when they are present below the lower limit of 0.01%. When they are present beyond their upper limits, not only is the improvement of the *r* value saturated, but also, the steel is hardened and the cold workability is lowered.

Phosphorus increases the steel strength through a solid solution hardening effect. But, on the other hand, it improves the r value and the deep-drawability. However, less than 0.40% of phosphorus is not effective for the improvement of the r value and more than 0.15% of phosphorus saturates this improvement effect and also hardens and embrittles the steel. Thus a preferable range of phosphorus is 0.040–0.10%.

The steel sheet having the above chemical composition is produced in the following way.

Molten steel prepared by a conventional steel making method is made into slabs by a conventional method. Boron may be added in a ladle or an ingot mold, and in a tandish in case of the continuous casting.

When the steel sheet is applied to metal coating for example, a galvanized sheet, it is desirable that the steel is made into a core-killed ingot. The slabs are reheated and then hot-rolled and coiled on a coiler.

Regarding the hot rolling finishing temperature, it is desirable that the finishing temperature is not less than $Ar_3$ point in order to assure a high *r* value.

As for the coiling temperature, it may be higher than 680° C, when the softer material and better deep-drawability is required. Also where the local deformation ability, such as, local stretching is important, it may be not higher than 680° C to finely disperse the carbides in order to prevent the coalescence and coarsening of the carbides which are harmful to the local deformation ability, or in order to improve the acid-pickling efficiency.

Even when the low coiling temperature below 680° C is applied, the steel sheet is softer and has not only better deep-drawability, but also, better ductility than the conventional Al-killed cold rolled steel sheet which is coiled at a high temperature.

The hot rolled coil is acid-pickled and cold rolled at a reduction of more than 30% and then subjected to a recrystallization annealing at a temperature between the recrystallization temperature and the $A_3$ point. It is then preferably subjected to an overageing treatment by continuous annealing, and then if necessary, to a temper rolling. The above processings can be effected by any method so long as the composition of steel falls within the specified range and is subjected to a cold rolling and a continuous annealing. As one example of the continuous annealing, the steel is held at a temperature above 650° C but below the $A_3$ point for less than ten minutes for recrystallization annealing, and then the steel is cooled to the overageing temperature or below the overageing temperature by a cooling rate of 5°– 30° C/sec. The overageing treatment may be done at a temperature between 200 and 500° C for 10 seconds to 10 minutes.

It is desirable that the recrystallization temperature is higher (for example between 800° C and the $A_3$ point) when better softness and better deep-drawability are required, and the temperature is lower (for example, between 680° and 720° C) when better ductility is required.

The present invention will be better understood from the following example.

EXAMPLE 1

The steels having chemical compositions shown in Tables 1 and 3 were prepared in a converter and subjected to conventional ingot-making, breaking-down or continuous casting and hot rolling above the $Ar_3$ point to obtain coils of 2.3 –2.7 mm thickness. The coils were cold rolled into 0.8 mm thickness, then subjected to a recrystallization annealing which comprises holding at 700° C for one minute and subsequent cooling (cooling rate is about 10° – 15° C/sec.), and to an overageing treatment comprising holding at 350° C for five minutes in a continuous annealing method, and then further subjected to a temper rolling of 1 – 1.5%. The mechanical properties of the resultant sheets are shown in Tables 2 and 4.

Table 1

| Grades | Chemical Composition (%) C | Si | Mn | sol.Al | B | N | Hot Rolling Coiling Temperature | Annealing Condition (Continuous Annealing) |
|---|---|---|---|---|---|---|---|---|
| L | 0.04 | 0.01 | 0.29 | 0.054 | — | 0.0065 | 720° C | 700° C × 1 min. +350° C × 5 min. |
| M | 0.04 | 0.01 | 0.30 | 0.031 | 0.0029 | 0.0054 | 620° C | |
| N | 0.03 | 0.02 | 0.19 | 0.040 | 0.0032 | 0.0057 | 650° C | |
| O | 0.05 | 0.01 | 0.21 | 0.045 | 0.0027 | 0.0061 | 700° C | |
| P | 0.008 | 0.02 | 0.22 | 0.031 | 0.0030 | 0.0053 | 700° C | |

Table 2

| Mechanical Properties | Grades L (comparison) | M (inventive) | N (inventive) | O (inventive) | P (inventive) |
|---|---|---|---|---|---|
| Yield Point (kg/mm²) | 28.5 | 23.4 | 21.8 | 20.4 | 19.4 |
| Tensile Strength (kg/mm²) | 37.7 | 34.7 | 32.5 | 31.8 | 30.8 |
| r value | 1.15 | 1.23 | 1.47 | 1.29 | 1.58 |
| Elongation (%) | 42 | 45 | 48 | 46 | 50 |
| C C V (mm) | 37.6 | 37.1 | 36.8 | 37.0 | 36.2 |
| E r value (mm) | 10.3 | 10.7 | 11.0 | 10.5 | 11.2 |
| Ageing Index (kg/mm²) | 0.6 | 0 | 0 | 0.5 | 0 |

Table 3

| Grades | Chemical Composition C | Si | Mn | sol.Al | B | N | P | Mo | W | Nb | Hot Rolling Coiling Temperature |
|---|---|---|---|---|---|---|---|---|---|---|---|
| Ⓠ | 0.04 | 0.01 | 0.28 | 0.041 | — | 0.0065 | 0.014 | — | — | — | 705° C |
| R | 0.04 | 0.01 | 0.29 | 0.015 | 0.0029 | 0.0051 | 0.049 | — | — | — | 620° C |
| S | 0.03 | 0.01 | 0.27 | 0.010 | 0.0032 | 0.0064 | 0.017 | 0.03 | — | — | 650° C |
| T | 0.04 | 0.02 | 0.28 | 0.012 | 0.0028 | 0.0048 | 0.015 | — | 0.03 | — | 635° C |
| U | 0.03 | 0.01 | 0.17 | 0.011 | 0.0035 | 0.0061 | 0.017 | — | — | 0.02 | 660° C |
| V | 0.03 | 0.01 | 0.19 | 0.020 | 0.0031 | 0.0058 | 0.062 | — | — | — | 630° C |
| W | 0.03 | 0.02 | 0.21 | 0.009 | 0.0027 | 0.0045 | 0.055 | — | 0.03 | — | 650° C |
| X | 0.03 | 0.02 | 0.21 | 0.009 | 0.0027 | 0.0045 | 0.055 | — | 0.03 | — | 720° C |
| Y | 0.04 | 0.01 | 0.30 | 0.018 | 0.0029 | 0.0054 | 0.015 | — | — | — | 650° C |
| Z | 0.009 | 0.02 | 0.19 | 0.022 | 0.0028 | 0.0050 | 0.053 | — | — | — | 700° C |

The mark Ⓠ shows comparative steel.

Table 4

| Grades | Yield Point (kg/mm²) | Tensile Strength (kg/mm²) | Elongation (%) | r value | CCV (mm) | E r value (mm) | Ageing Indices (kg/mm²) |
|---|---|---|---|---|---|---|---|
| Ⓠ | 27.5 | 37.3 | 41 | 1.16 | 37.6 | 10.0 | 0.5 |
| R | 23.9 | 35.0 | 45 | 1.43 | 37.0 | 10.6 | 0 |
| S | 22.4 | 33.8 | 45 | 1.41 | 36.9 | 10.7 | 0 |
| T | 23.4 | 34.7 | 45 | 1.45 | 37.0 | 10.6 | 0 |
| U | 23.7 | 35.0 | 44 | 1.62 | 36.9 | 10.5 | 0 |
| V | 24.0 | 35.1 | 45 | 1.68 | 36.9 | 10.5 | 0 |
| W | 23.8 | 34.8 | 45 | 1.60 | 36.7 | 10.7 | 0 |
| X | 22.0 | 33.7 | 46 | 1.71 | 36.6 | 10.4 | 0.5 |
| Y | 21.4 | 32.7 | 45 | 1.21 | 37.3 | 10.4 | 0 |

Table 4-continued

| Grades | Yield Point (kg/mm²) | Tensile Strength (kg/mm²) | Elongation (%) | r value | CCV (mm) | E r value (mm) | Ageing Indices (kg/mm²) |
|---|---|---|---|---|---|---|---|
| Z | 20.1 | 32.3 | 49 | 1.75 | 36.0 | 11.2 | 0 |

The mark ⓪ shows comparative steel.

As understood from Table 2 the present inventive steels are softer and better in cold workability than the comparative steels and are substantially non-ageing. And the present inventive steels, even when the continuous annealing is applied after the cold rolling, have good cold workability. This is due to the addition of a very small amount of boron (B/N<1.0).

The extremely low C and Mn steel P shows very excellent cold workability.

As is understood from Table 4, the steel sheets (containing one or more of P, Mo, W and Nb) obtained according to the present invention are not only non-ageing, but also softer, more ductile and better in deep-drawability than the comparative steel Q (Al-killed and coiled at a high temperature) and are better in deep-drawability than the inventive steel Y containing no P, W, Mo and Nb. Further in the present invention, it is possible to produce a cold rolled steel sheet having deep-drawability similar to an Al-killed and box annealed material by reducing the manganese content to less than 0.25%, and still further, the steel Z which has been vacuum degassed to reduce the carbon content less than 0.015% shows very excellent workability.

What is claimed is:

1. A method for producing an Al-killed cold rolled steel sheet having excellent cold-workability and aging resistance, which comprises hot rolling and cold rolling a steel comprising C ≦ 0.10 %
Si ≦ 0.10 %
Mn ≦ 0.50 %
N ≦ 0.008 %
sol.Al: 0.003 – 0.080 %
B: 0.0020 – 0.0050 % and wherein the ratio B/N is less than 1.0, and the sum (Al + B) is ≦ 20 × N(%), with the balance being iron and unavoidable impurities and then subjecting the thus obtained steel strip to recrystallization annealing at a temperature between 650° C and the $A_3$ point for not longer than 10 minutes by a continuous annealing method and thereafter cooling the strip at a cooling rate from about 5° to 30° C/sec.

2. The method of claim 1 in which the steel contains not more than 0.02% Si as an unavoidable impurity.

3. The method of claim 1 in which the carbon content of the steel is reduced to not more than 0.015% by vacuum degassing.

4. The method of claim 1 in which the steel contains not more than 0.25% Mn.

5. The method of claim 1 in which the steel contains 0.015 to 0.06% Al.

6. The method of claim 1 in which the steel contains one or more of 0.01 to 0.08% W, 0.040 to 0.15% P, 0.01 to 0.10% Mo, and 0.01 to 0.08% Nb.

7. The method of claim 6 in which the carbon content of the steel is reduced to not more than 0.015% by vacuum degassing.

8. The method of claim 6 in which the steel contains not more than 0.25% Mn.

9. The method of claim 1 in which the steel strip after the recrystallization annealing and cooling is subjected to an overageing treatment at a temperature between 200° and 500° C for about 10 seconds to 10 minutes.

10. The method of claim 1 in which the hot rolled steel strip is coiled at a temperature not lower than about 680° C for obtaining better deep-drawability.

11. The method of claim 1 in which the hot rolled steel strip is coiled at a temperature not higher than about 680° C for obtaining better local-deformation ability.

12. A cold rolled steel sheet produced by the method of claim 1.

13. A cold rolled steel sheet produced by the method of claim 6.

* * * * *